US007040078B2

(12) United States Patent
Vandevoorde et al.

(10) Patent No.: US 7,040,078 B2
(45) Date of Patent: May 9, 2006

(54) APPARATUS FOR FITTING STRETCHABLE SLEEVES

(75) Inventors: Jean-Claude René Vandevoorde, Montdidier (FR); Philippe Jacques Thebault, Montdidier (FR)

(73) Assignee: Protection Decoration Conditionnement Europe, Montdidier (FR)

( * ) Notice: Subject to any disclaimer, the term of this patent is extended or adjusted under 35 U.S.C. 154(b) by 28 days.

(21) Appl. No.: 10/744,447

(22) Filed: Dec. 23, 2003

(65) Prior Publication Data

US 2005/0081487 A1 Apr. 21, 2005

(30) Foreign Application Priority Data

Dec. 24, 2002 (FR) ..... 02 16641

(51) Int. Cl.
*B65B 53/00* (2006.01)
*B65B 11/00* (2006.01)

(52) U.S. Cl. ..... 53/556; 53/567; 53/585

(58) Field of Classification Search ..... 53/556, 53/567, 585, 291–296
See application file for complete search history.

(56) References Cited

U.S. PATENT DOCUMENTS 4,238,267 A * 12/1980 Konstantin ..... 53/292
4,293,364 A * 10/1981 Fujio ..... 53/585
4,519,186 A * 5/1985 Winter et al. ..... 53/585
4,562,684 A * 1/1986 Dreher ..... 53/585
5,060,367 A * 10/1991 Vandevoorde ..... 53/585
5,101,613 A * 4/1992 Wilhelm et al. ..... 53/585
5,398,395 A * 3/1995 Woolls ..... 53/292
5,483,783 A 1/1996 Lerner et al.
5,569,351 A * 10/1996 Menta et al. ..... 53/585
5,715,651 A * 2/1998 Thebault ..... 53/585
6,474,390 B1 * 11/2002 Vandevoorde ..... 53/585

FOREIGN PATENT DOCUMENTS

EP 0292018 A2 11/1988
EP 0368663 A1 5/1990
FR 2738797 A1 3/1997
JP 05132036 A * 5/1993

* cited by examiner

*Primary Examiner*—Stephen F. Gerrity
(74) *Attorney, Agent, or Firm*—Drinker Biddle & Reath LLP

(57) ABSTRACT

Method and apparatus for fitting stretchable sleeves on containers in the form of a substantially prismatic or cylindrical carton, the opening of which is at least partially surrounded by a rim projecting out towards the exterior. Sleeves are cut from a stretchable sheath and stretched to assume a section slightly bigger than the section of the carton. The sleeve is placed on the carton by moving it from above the base in the direction towards the rim. The apparatus comprises a sheath feed and a sleeve cutting device, a transfer drum equipped with transfer elements, and a placing turret equipped with placing units with two placing elements, each having a stretching tool and a clamping block. A container feed positions the containers, in steps, in synchronization with the placing elements, in the placing zone, the base of the container being turned towards the placing elements.

8 Claims, 11 Drawing Sheets

APPARATUS FOR FITTING STRETCHABLE SLEEVES

FIELD OF THE INVENTION

Figure 1:
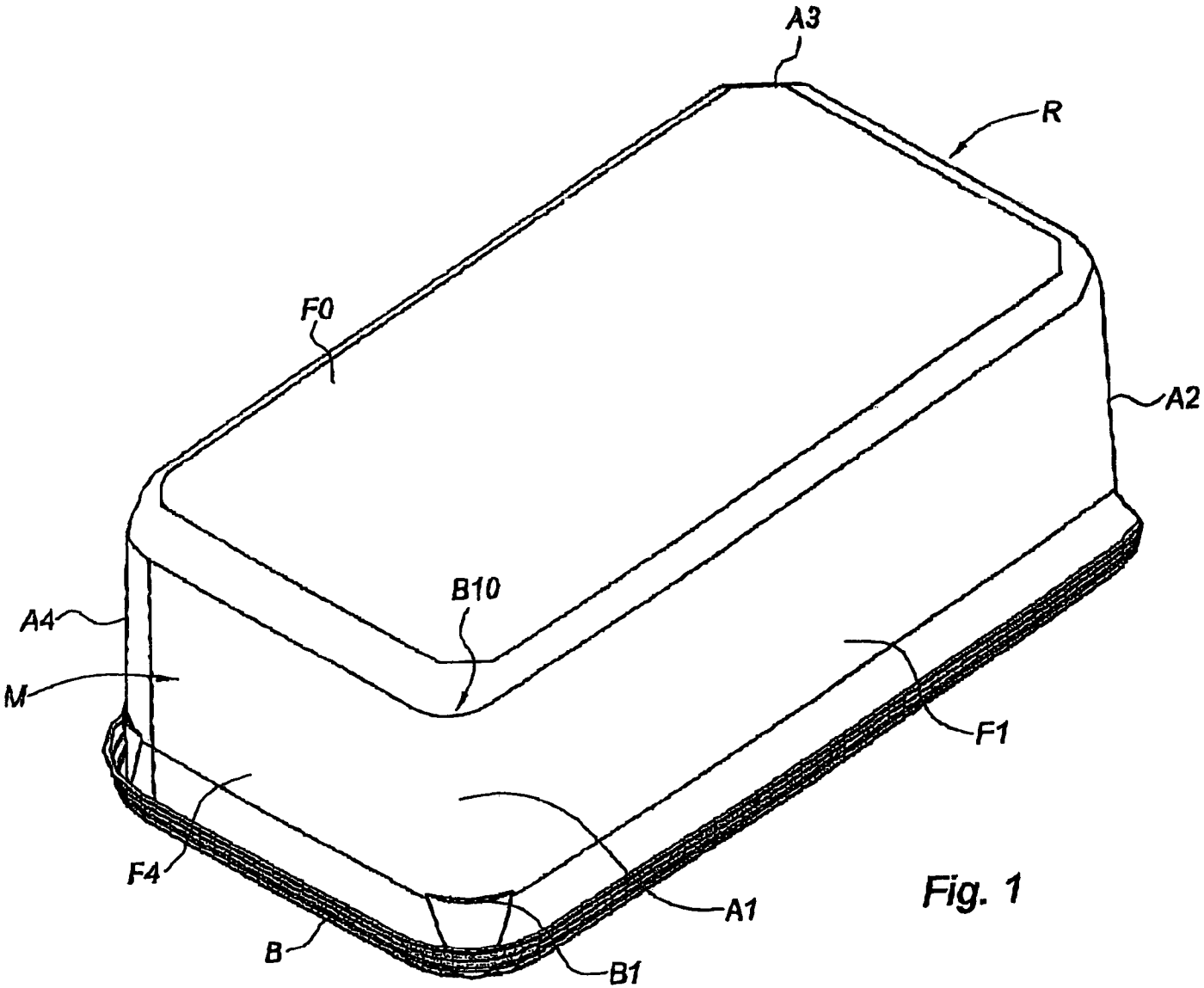

The present invention relates to a method and apparatus for placing stretchable sleeves on containers in the form of substantially prismatic cartons, and in particular cartons which can be stacked, with an opening at least partially surrounded by a rim projecting out towards the exterior.

The invention generally relates to the application of a facing around a carton body with a prismatic shape, including in the more general sense a cylindrical or truncated cone shape, with pronounced edges or a continuous peripheral surface.

PRIOR ART

Generally speaking, some containers intended to contain products for retail distribution, such as cleaning products or food products, are designed in the shape of a substantially prismatic carton, the sides of which decrease towards the base so that the empty cartons leaving the production line can be stacked. The cartons are generally made from plastic with very thin walls and may optionally have labels affixed to the sides to identify the product or provide detailed information about the contents of the container. The top part of these containers generally terminates with a rim, which projects out towards the exterior, both as a means of imparting extra rigidity to the container and to enable a foil and/or a lid to be fitted if necessary, sealing off the interior of the container.

However, affixing labels to such containers is not an easy operation, especially as it involves applying a peripheral label.

A known approach is to provide such containers with a heat-shrunk jacket. However, this solution of facing a container is only possible in certain applications. First of all, the container, and in particular its contents, are required to undergo the heat-shrinking process which, although brief, nevertheless involves a certain increase in temperature, which places the products contained in the container at risk of deterioration. Furthermore, this heat-shrinking process is generally only possible if the carton has a terminated edge, due to the very imprecise positioning of the very wide sleeve which is placed around the container. This shrinkable sleeve can not be precisely positioned relative to the container because of its extra dimension and there exists no means by which the sleeve can be held until the point at which it is shrunk.

Under these conditions, the overall appearance of the sleeve, once shrunk, suffers due to this lack of precision during positioning, and the only way of making heat-shrunk packaging of this type is if the package has markers, although these are not crucial to the overall appearance of the product.

OBJECTIVE OF THE INVENTION

The objective of the present invention is to develop a method and an apparatus that will enable stretchable sleeves to be placed on containers in the form of a substantially prismatic carton, enabling the entire side face of the container to be used to effect as a means of displaying the brand and any information which might be necessary or which can not be placed on the lid, enabling a final product to be obtained which is not only attractive in terms of its front face but also due to a facing placed on the body of the container in such a way that, regardless of the position in which the product or the container is presented, any information, such as the brand, will be readily apparent.

EXPLANATION OF THE INVENTION AND ITS ADVANTAGES

To this end, the invention relates to a method of placing stretchable sleeves on containers in the form of a substantially prismatic carton, having a rim projecting out towards the exterior, characterised in that sleeves are cut from a stretchable sheath, the sleeves are stretched to obtain a section that is slightly bigger than the section of the carton on which the sleeve is to be placed and the sleeve is placed on the carton by moving it from above the base in the direction towards the rim.

The invention further relates to an apparatus for placing such sleeves on containers in the form of a prismatic carton having a rim projecting out towards the exterior, this apparatus being characterised in that it comprises

- a sheath feed which unreels a stretchable sheath into a sleeve cutting device,
- a transfer drum equipped with transfer elements picking up each sleeve at the output of the cutting device in order to open it and transfer it to a placing unit,
- a placing turret equipped with placing units having at least two placing elements, each with a stretching tool and a clamping block to pick up a sleeve from a transfer element, stretch the sleeve and clamp it against the stretching tool with the clamping plate,
- a container feed,
  - placing the container R in steps, in synchronisation with the placing elements, in the placing zone, the base of the container being turned towards the placing elements in the placing zone,
- a set of control means managing the relative motion of the placing elements with respect to the container in the placing zone,
- controlled placing elements which place the sleeve on the container in a jacket arrangement by moving it from above the base of the container in the direction towards the rim until the sleeve sits on the container in the intended position, releasing it by a retracting motion of the stretching tools relative to the sleeve out of the gap between the wall of the container and the blocks, the latter remaining in position set back from the stretching tools.

Accordingly, the method and apparatus proposed by the invention enable containers to be efficiently faced with a stretchable sleeve, the containers having a rim around their opening, projecting out towards the exterior.

The invention enables this sleeve to be fitted by slipping the sleeve on from above the base of the container, this fitting process only being possible because the stretching tools placing the sleeve on the container are retracted but the sleeve is still held by the clamping blocks, at least at the start of this retracting motion. The invention enables the sleeve to be placed on the container with extremely precise positioning, which, by contrast with heat-shrunk sleeves, improves both the strength and the solidity of the container, generally made from a very fine plastic, enabling a facing to be applied to the body of the container without spilling over onto the lid. Consequently, the container will be identifiable irrespective of its positioning or its orientation on a display shelf in a retail display and the sleeve will not be destroyed when the lid is taken off.

As a result of another feature, the transfer elements each comprise two arms which are controlled so as to pivot relative to one another so that they can be moved towards or apart from one another, and are terminated by a vacuum box provided on their surface directed towards a vacuum suction surface, the vacuum in the arms being controlled depending on the rotary position of the drum.

This makes the transfer drum simple and light in terms of construction, with little inertia since, in effect, it constitutes a hub bearing the transfer elements, the pivoting motion of which can be controlled by cams. These transfer elements can be very easily adapted to different sizes of sleeves, especially as they are not required to hold the sleeves along their entire length but only a part thereof, affording a big enough surface to enable them to be transported.

By virtue of another advantageous feature, each placing element comprises a support bearing the stretching tool and the clamping block, the support being fitted with guide and control means in order to guide the stretching tool in translation in the stretching direction and the block in a direction substantially parallel with the rear surface of the stretching tool. This embodiment of the placing elements is generally identical within a same placing unit, given that the containers are generally symmetrical, which simplifies the configuration of these elements and the task of managing tools; these placing elements are adapted to the shape of the container on which the sleeve is to be placed. Depending on the size of the containers, the placing elements on the placing units in the machine merely have to be changed. Since the placing elements on the right and left-hand sides are identical, this does not create any additional problems in terms of tool management.

However, depending on the containers, the invention also enables containers that are non-symmetrical in shape, for example trapezoidal, to be faced with a sleeve. The invention also enables containers with a polygonal cross section more complex than a rectangular cross section to be faced under the same conditions. Furthermore, the invention enables containers of a rounded or even circular shape to be faced.

Expediently, in order to enable the stretching tool to be released after positioning the sleeve whilst the sleeve is still held by the clamping block, it is of practical advantage for the support of the placing element to have two posts on which the clamping block is mounted in a sliding arrangement.

The stretching tool is advantageously provided in the form of a curved block comprising two parts of a thin shell-type shape, designed to straddle the corresponding corner edges of the container as the sleeve is being placed. This very simple embodiment of the stretching tool enables a gap to be left free between the shell-shaped regions on a level with the corners, which leaves sufficient space free for the sleeve to be extended as it is stretched since it sits on nothing more than the four shell-shaped regions at the corners of the cross section (two shells per stretching tool). This also facilitates the process of placing and hooking the sleeve on the container and then releasing the stretching tool, because the sleeve is applied against the wall of the container in the gap between the two parts of each stretching tool and in the transverse direction, between the two stretching tools.

At the same time, because the clamping block continues to be applied against the sleeve as the stretching tool is retracted, the sleeve is prevented from shifting relative to the container.

In order to facilitate placement of the sleeve whilst enabling the stretching tool to be retracted, it is of practical advantage if the clamping block is provided with a surface complementing the rear surface of the stretching tool and has fittings on a level with each corner, which co-operate with the rear surface of the shell-shaped parts of the stretching tool, these fittings having a higher capacity to adhere to the sleeve material than that of the rear surface of the stretching tool shells.

Finally, another embodiment which advantageously assists the releasing motion of the stretching tool, is characterised in that the placing zone of the apparatus has:

- a control means in the form of a cam, and the clamping block of each placing element has a wheel co-operating with the cam in order to hold the clamping block immobile relative to the container in the placing zone, and
- a control means co-operating with the support and/or the stretching tool in order to control the releasing motion of the stretching tool in the gap between the sleeve and the container.

DRAWINGS

Figure 2:
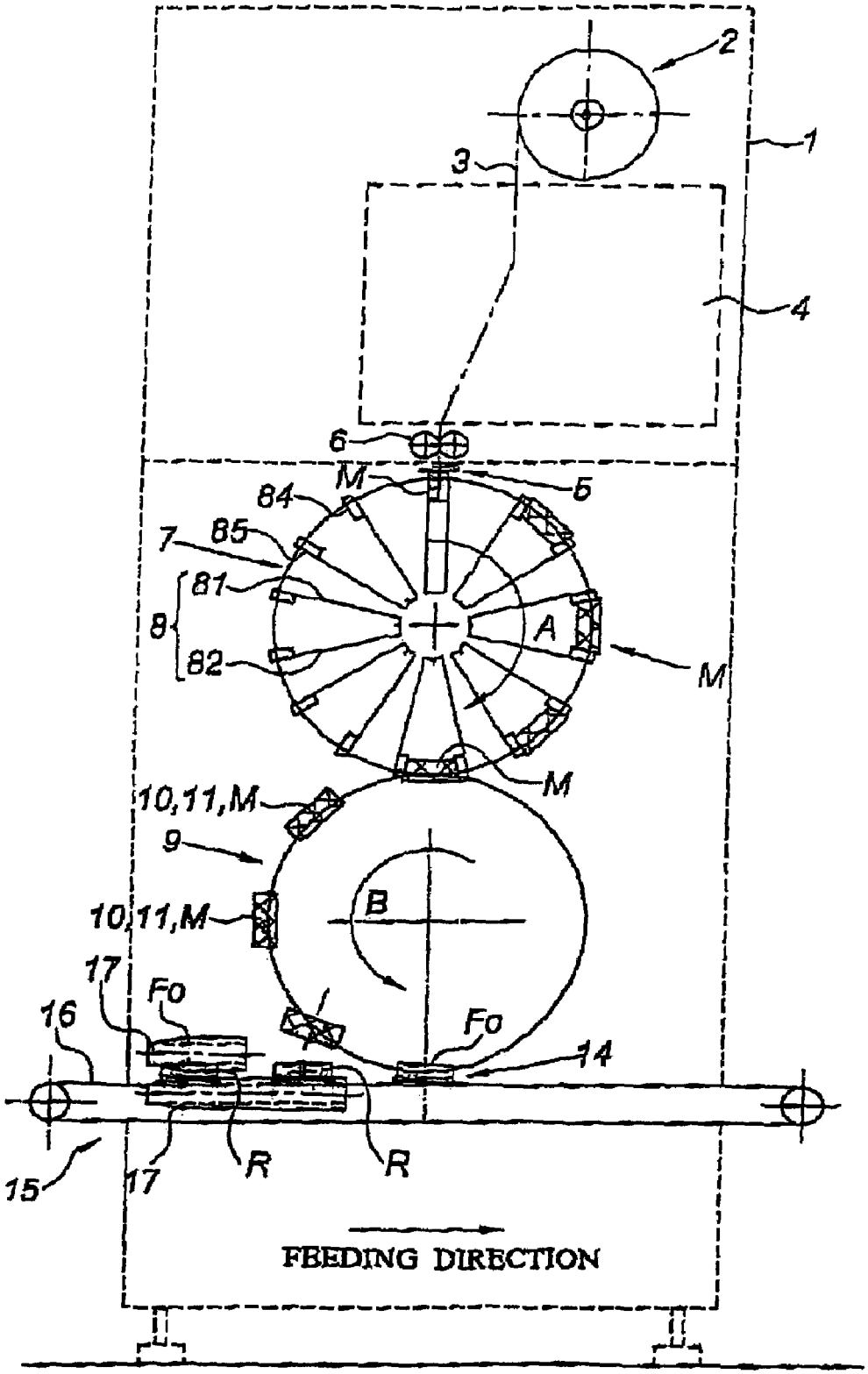
Figure 3:
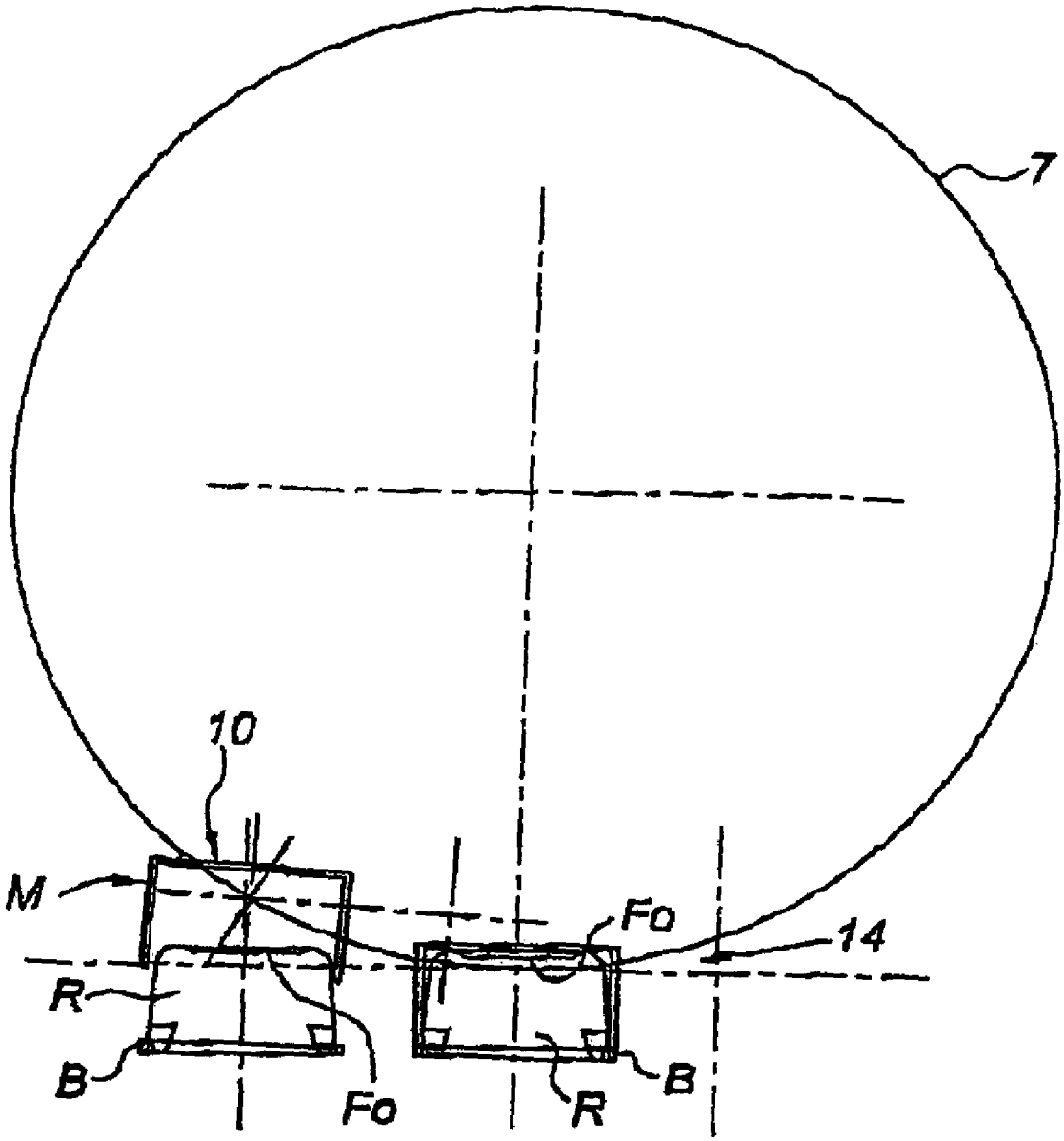
Figure 4:
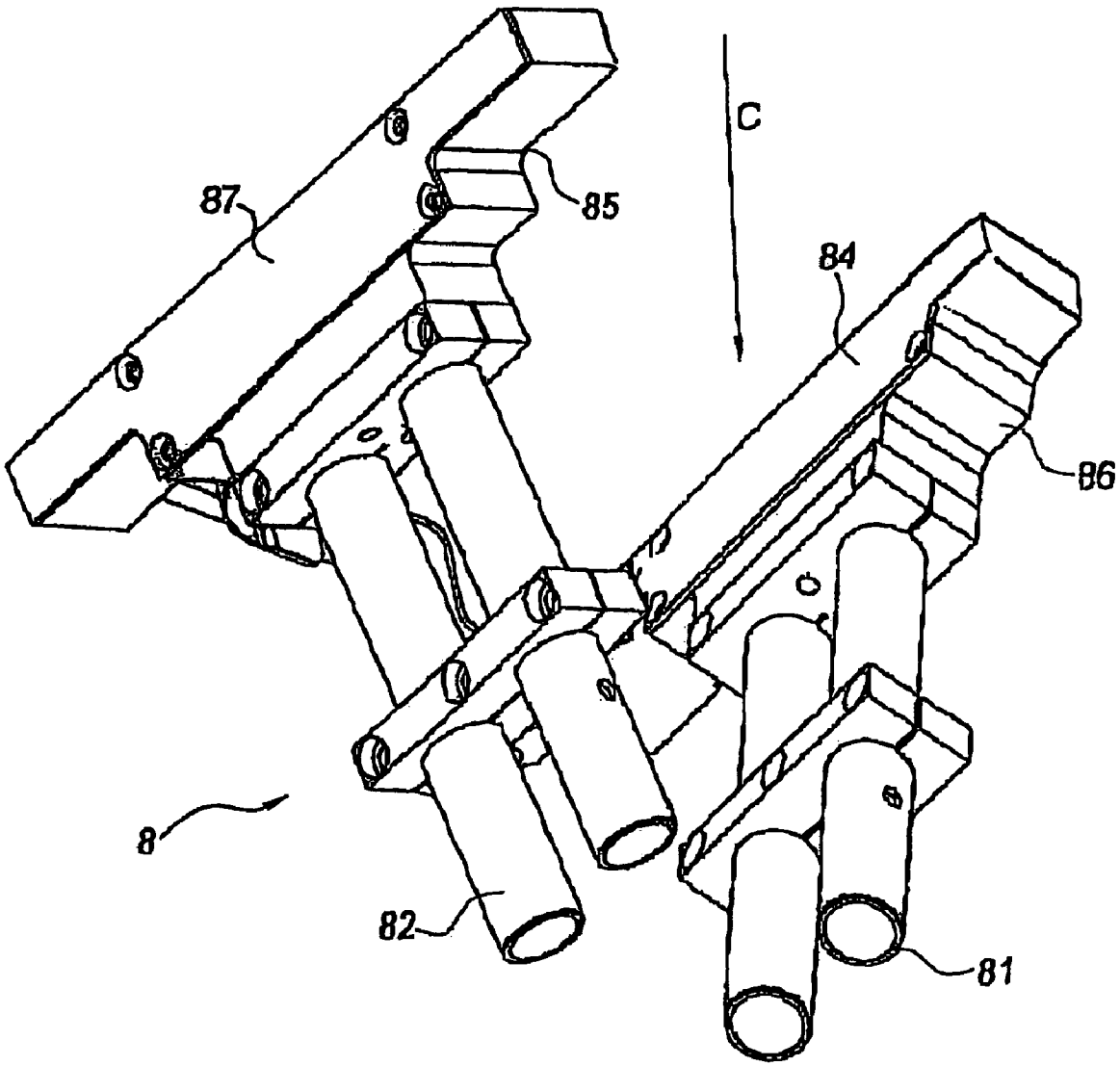
Figure 5:
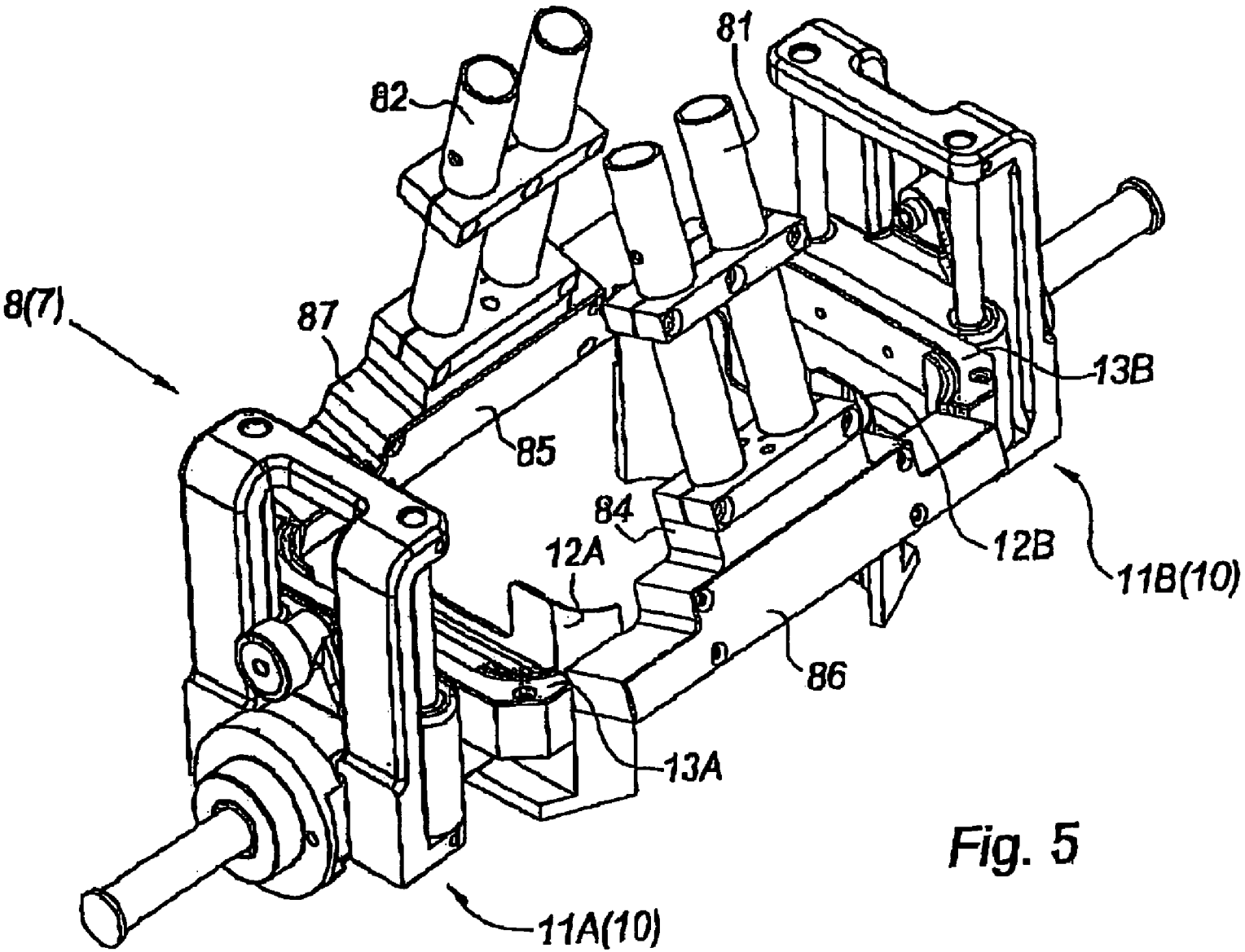
Figure 6A:
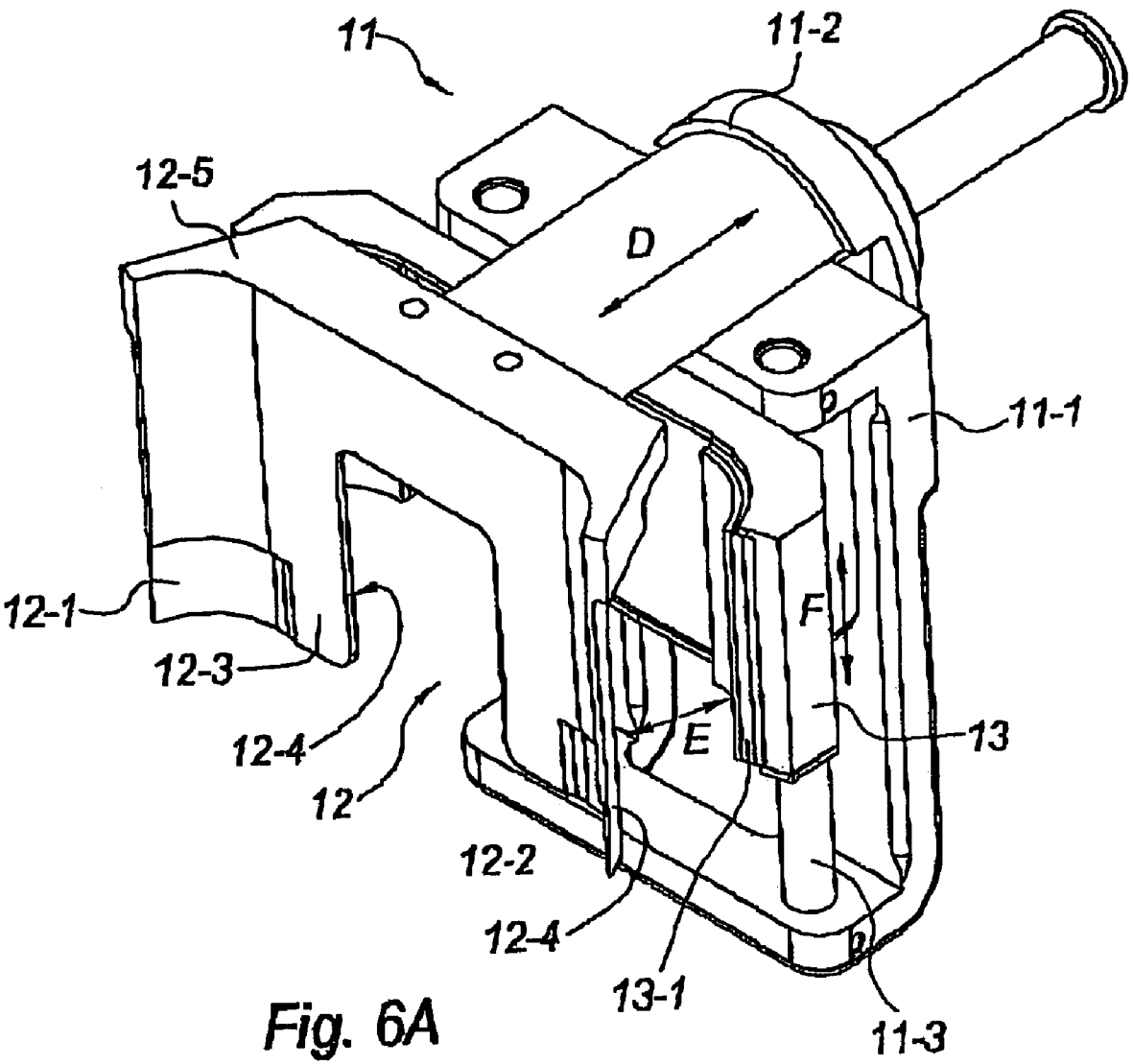
Figure 6B:
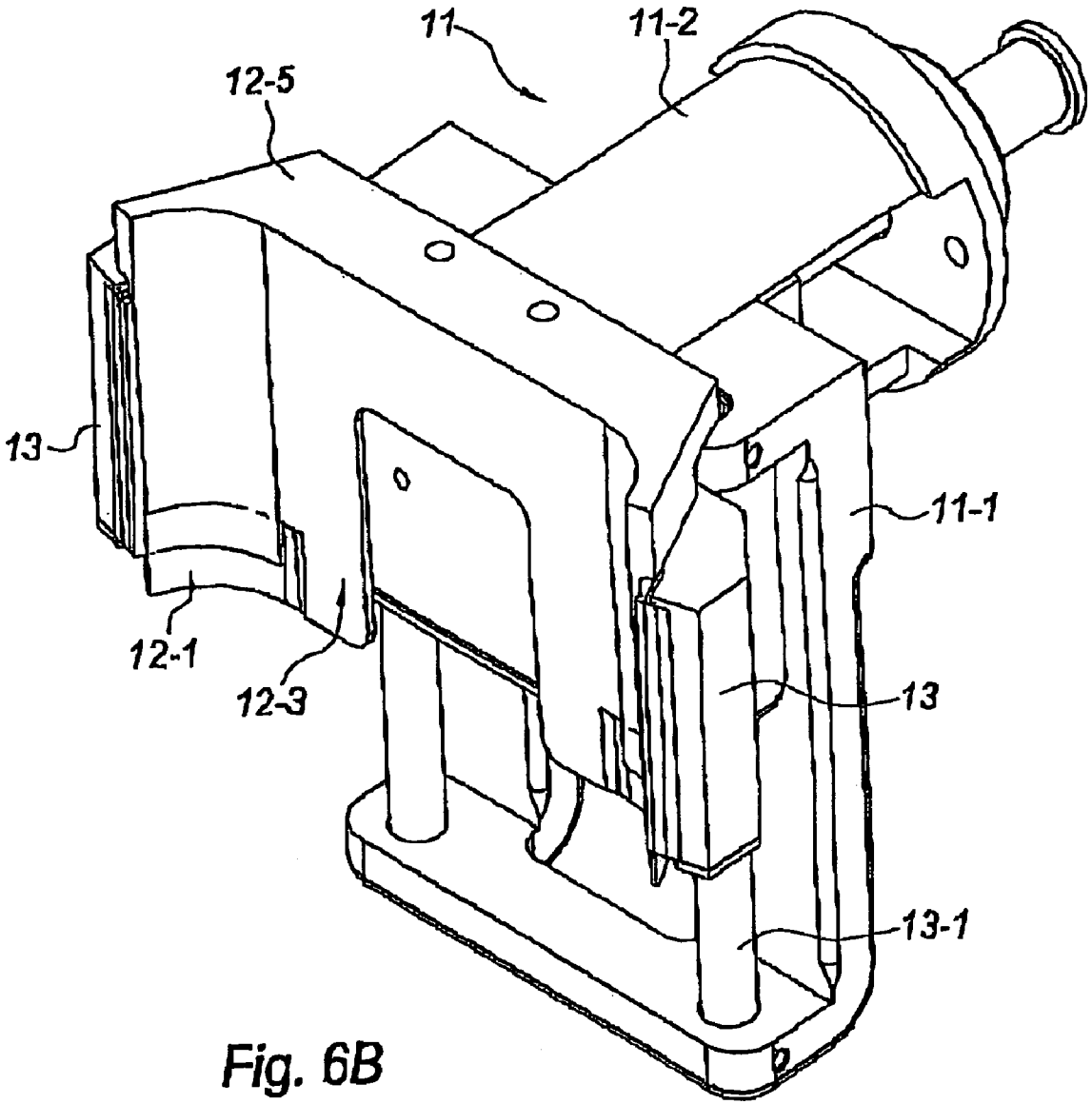
Figure 6C:
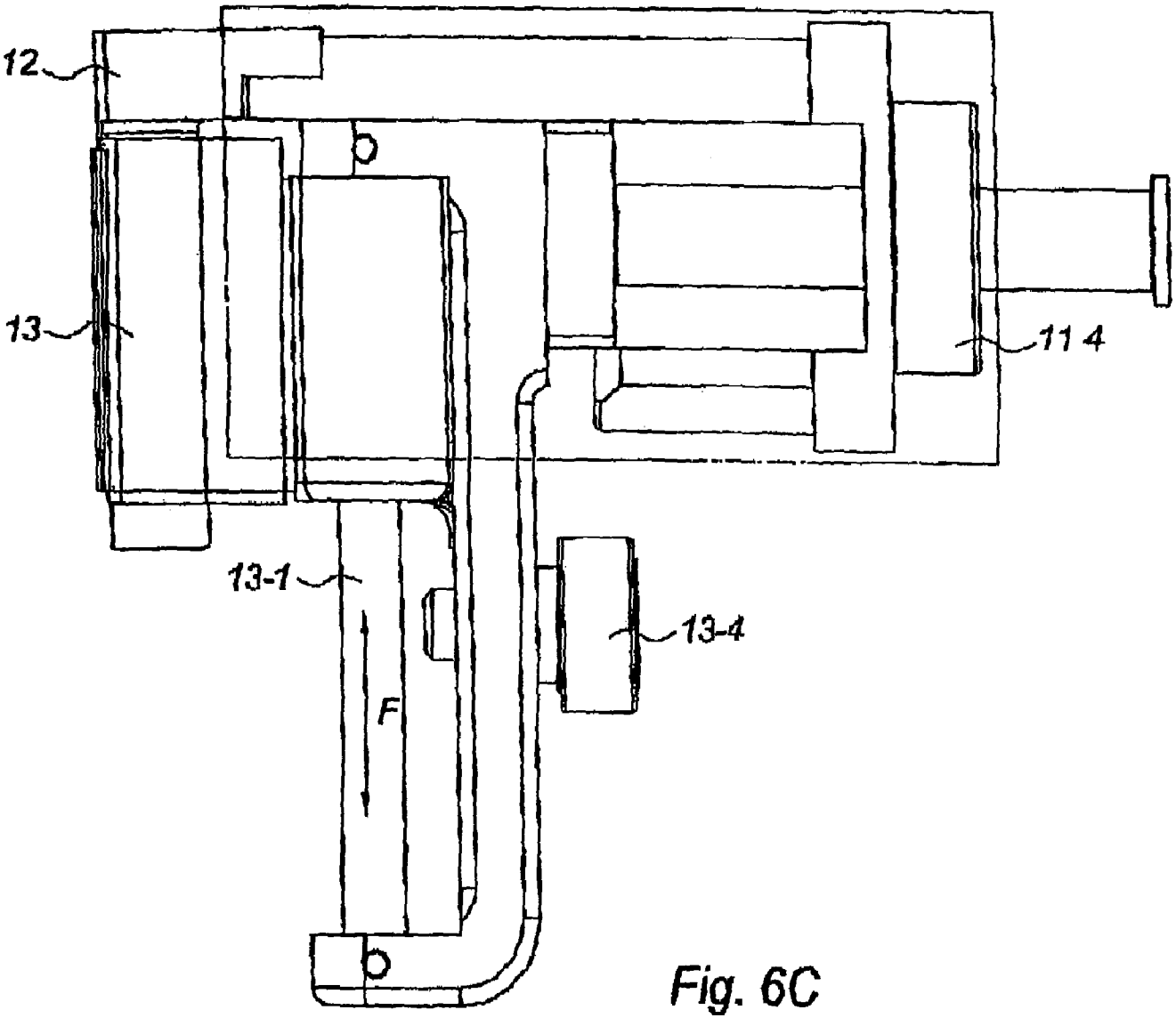
Figure 7A:
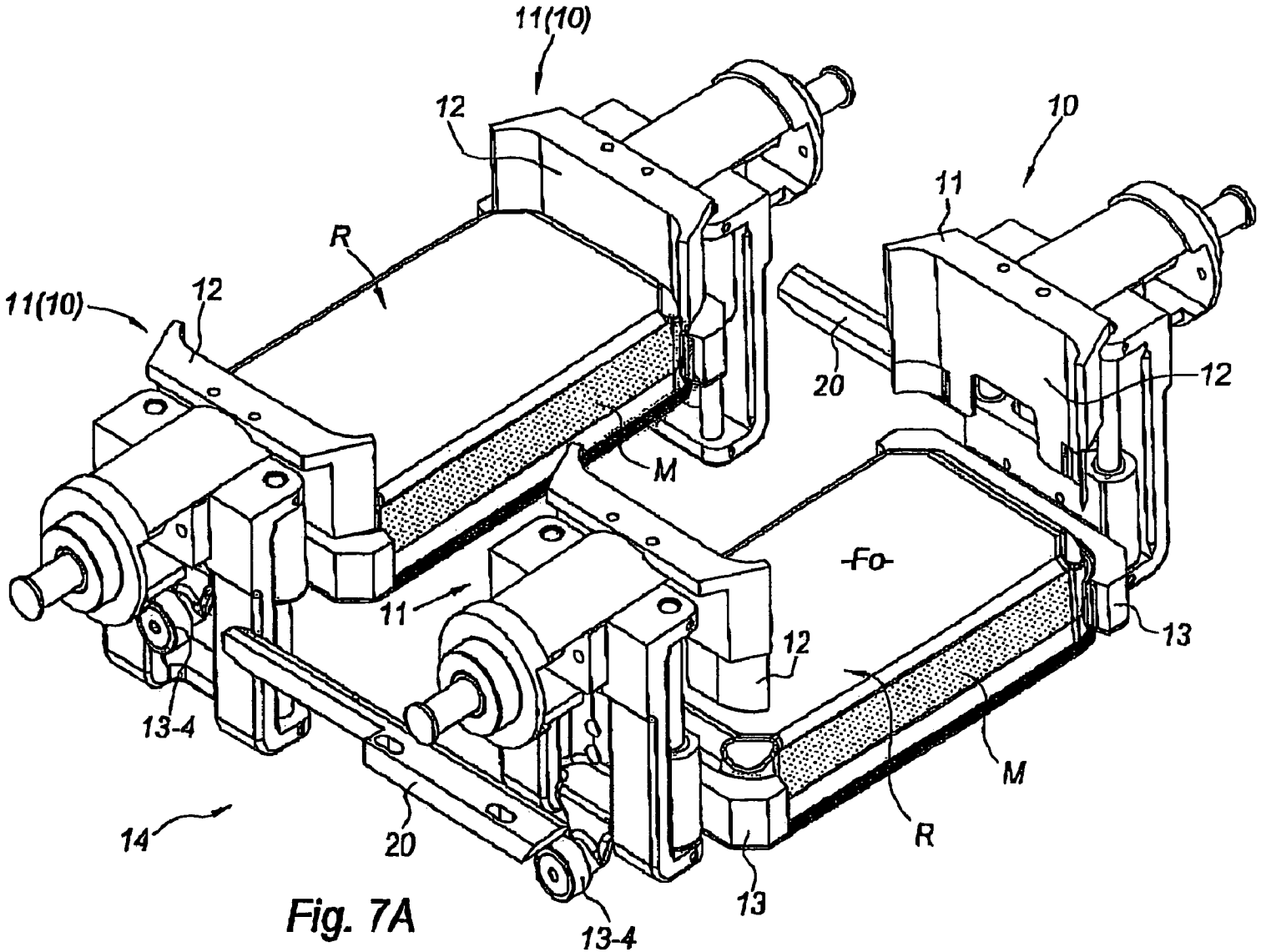
Figure 7B:
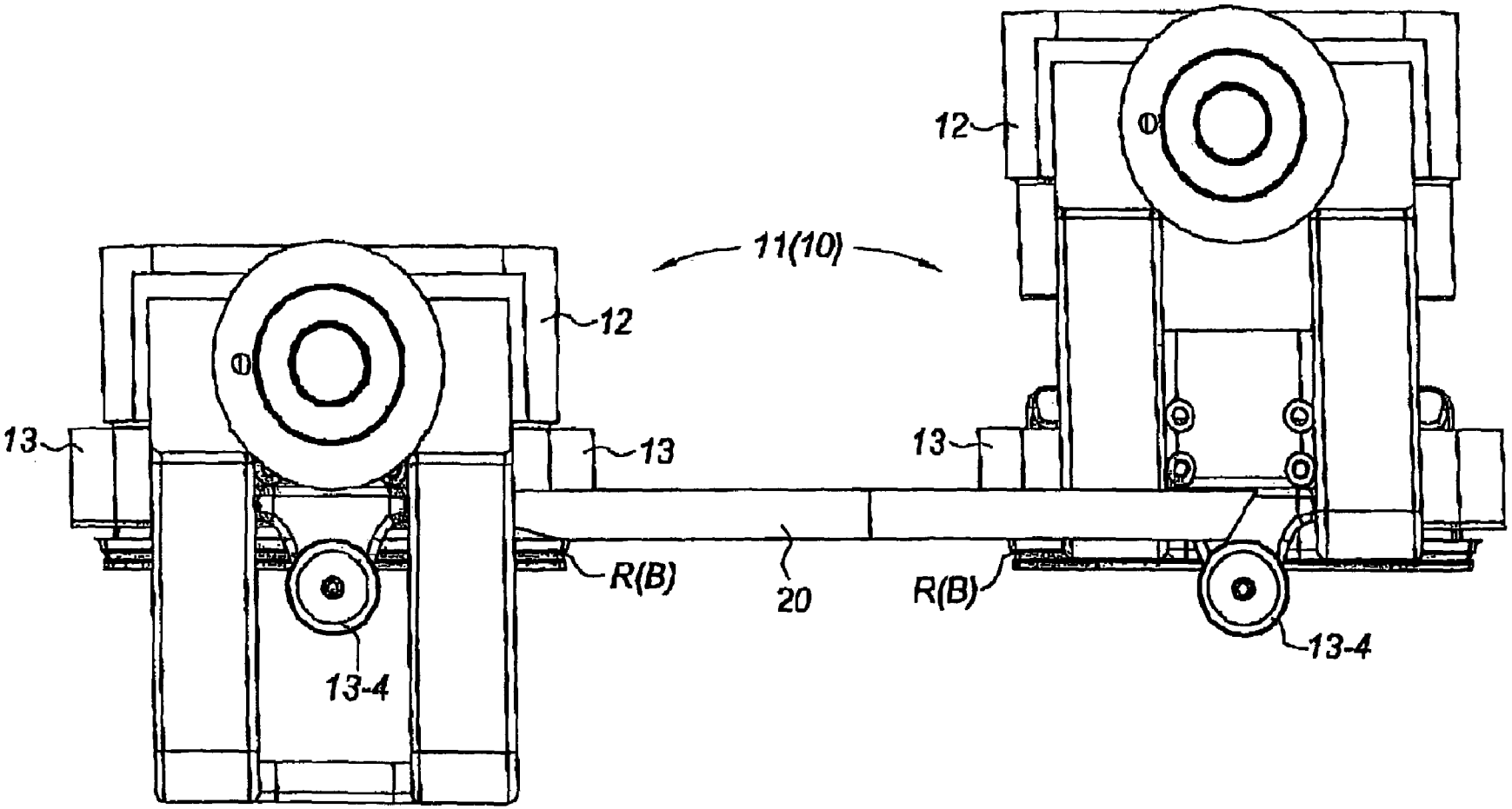
Figure 8:
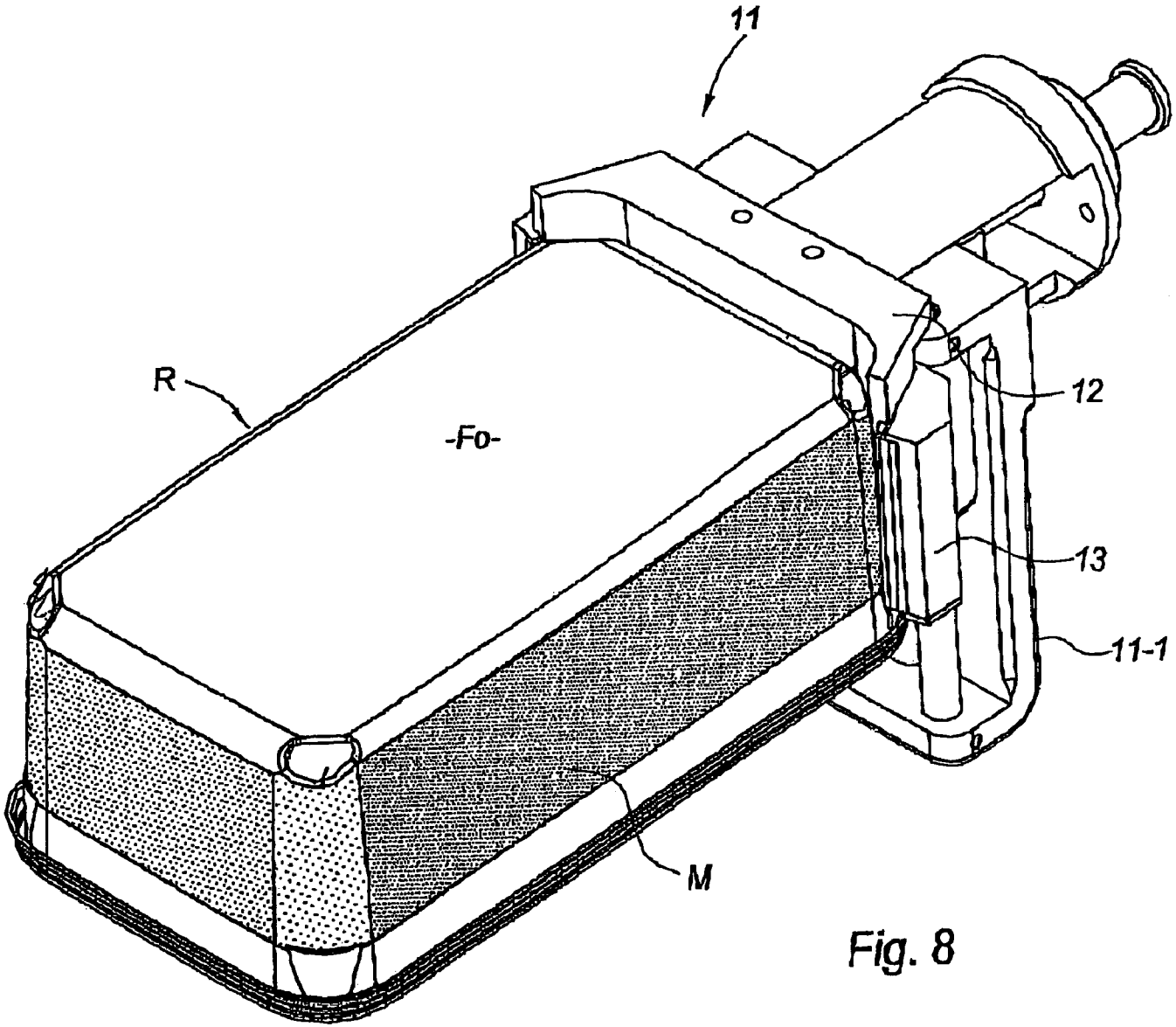

The method and the apparatus by which it is implemented will be described hereafter in more detail with reference to the appended drawings, depicting an embodiment of an apparatus for placing stretchable sleeves on containers in the form of a substantially prismatic carton and having a rim projecting out towards the exterior, in which:

FIG. 1 is a perspective view of an upturned container fitted with a stretchable sleeve as proposed by the invention, FIG. 2 is a very simplified overall diagram illustrating an apparatus for fitting stretchable sleeves as proposed by the invention, FIG. 3 is a diagram illustrating how a sleeve is fitted on a container in the sleeve placing zone, FIG. 4 is a perspective view of a sleeve transfer element in the open position at the region where a sleeve arrives downstream of the sleeve cutting device, FIG. 5 is a perspective view of a sleeve transfer element co-operating with a sleeve placing unit in the transfer zone, at the instant when the sleeve is being transferred by the transfer elements to the placing unit, FIGS. 6A, B, C are three perspective views showing a transfer element FIG. 6A depicting a perspective view of the open placing element, FIG. 6B showing a perspective view of the closed placing element, FIG. 6C showing a side view of the placing element, FIG. 7A show two placing units in the placement phase, FIG. 7A depicting a perspective view of the two placing units, FIG. 7B showing a side view of the two placing units, FIG. 8 shows a perspective view of a placing element engaged on the container, at the end of the process of placing the sleeve on the container.

DESCRIPTION OF AN EMBODIMENT OF THE INVENTION

The invention relates to an apparatus for placing stretchable sleeves on containers. designed to contain a whole range of products, such as commonplace consumer products, cleaning products, etc. . . . A container R of this type is generally prismatic in shape, for example with four faces F1–F4. These faces are bordered by edges A1–A4. The opening opposite the base Fo is bounded at the exterior by a rim B, the purpose of which is both to impart rigidity to the carton, given that it is generally made from quite a thin film, and to receive a lid or a cover.

To facilitate nesting and stacking of the empty cartons on leaving the production line, the carton is not exactly prismatic in shape and its shape decreases slightly towards the base Fo, so that the base Fo is slightly smaller than the opening.

For the purposes of the invention, the body of this carton is fitted with a sleeve M made from a stretchable plastic material bearing various indications or inscriptions, such as a figurative brand design or a name, instructions for use or a description of the contents. This sleeve M is indicated by a hatched zone.

The positioning of the sleeve M on the body of the carton R is very precisely defined and the sleeve must remain in this position, which may be facilitated by flattening the edges A1–A4 at the point where the sleeve M is to sit, so that it is bounded at the top and bottom by two stops such as the stops B1–B10 at the edge A1. This prevents any risk of the sleeve M sliding when the cartons are nested one in the other before being filled with the product.

The stretchable sleeve M is positioned with the aid of the machine illustrated in FIG. 2. This machine comprises a frame 1 equipped with a support to accommodate a reel 2 bearing a sheath 3 from which the sleeves will be cut. This sheath has already been imprinted. It is fed through guiding and centring means 4, not illustrated, so as to arrive at a cutting device 5, driven by unreeling rollers 6. The cutting device 5 has a guillotine blade which opens wide enough for the sheath 3, pushed along by the unreeling rollers 6, to be fed into the gap between the blade and the counter-blade; the blade is controlled as a function of the length of the sleeve to be cut.

Underneath the cutting device is a transfer drum 7 with transfer elements 8. These transfer elements 8 each have two substantially radial arms 81, 82, linked so as to pivot in the radial direction on a level with their inner end 83. Their mutually facing outer ends have vacuum-operated suction surfaces 84, 85 linked via the arms to a vacuum source. The ends are not linked to this source except during the active part of their travel when they are transferring the sleeve M as the drum 7 rotates. This drum 7 rotates in the direction of arrow A. During this rotating motion, the arms 81, 82 of the transfer elements 8 pivot in order to close and open. When a transfer element 8 comes close to the cutting device 5, the first arm 81 moves beyond the cutting position and comes to a halt as the drum 7 continues to rotate. During this time, the sheath 3 lowers the length of sheath; the other arm 82 then moves into abutment against the sheath as the knife cuts the sleeve M. The suction surfaces 84, 85 of the arms 81, 82 are placed under vacuum on a level with the zone in which they receive the sleeve so as to hold the sleeve by its two faces and open it. This opening operation takes places as the transfer drum continues to rotate, as illustrated.

Adjacent to this transfer drum, the machine has a sleeve placing turret 9. This rotating turret has two flanges in the form of discs, parallel with the plane of the drawing and spaced at an adjustable distance apart. These flanges, fitted with support, adjusting and control means, not illustrated, support placing units 10 between them. Each placing unit 10 has two placing elements 11, each with a stretching tool 12 and a clamping block 13, which will be described below. The two placing elements of each unit 10 are each supported by a flange of the turret. The turret 9 rotates in the same direction of rotation (arrow B) as the transfer drum 7. In FIG. 2, the placing units, their placing elements 11 and the sleeve 10 which they are carrying are schematically illustrated by a hatched rectangle; these units and elements are illustrated in more detail in FIG. 4 and the subsequent drawings.

During the transfer, the sleeve is fed on the two placing elements 11 into the gap between the two flanges and these elements 11 move apart from one another in order to stretch the sleeve to the dimension necessary to fit it on the container R.

In the non-stretched state, the sleeve M has a perimeter which is smaller than that which it will assume when placed on the container R and, for this reason, the sheath is specified on the basis of this dimension. In this embodiment and as a more general rule, the containers have a dimension in the order of 10 to 30 centimetres in the direction in which they are fed through the machine and, in order to simplify their design, the stretching tools are provided in the form of a part of fixed length in this direction so that stretching will be achieved as a result of the gap created by the stretching tools in the transverse direction. However, since the surface of the stretching tools on which the sleeve is supported is smooth, not only can the sleeve be regularly stretched between the two stretching tools 12 of the placing unit 10, it is also able to slide transversely on each stretching tool. This avoids having to use a stretching tool design with two parts, which would move apart not just in the transverse direction but also in the longitudinal direction, i.e. the feed direction.

If, as the sleeve is passed from the transfer element 8 to the placing unit 10, the clamping blocks 13 have been clamped against the sleeve M and the stretching tools 12, it is desirable to release them at least slightly at this stage to ensure as regular stretching as possible around the entire periphery of the sleeve.

Although the transfer elements 8 are not precisely dimensioned on the basis of the sleeve M, given that they are merely required to pick it up and open it, the same is not true of the placing units 10 of the stretchable sleeve. The dimensions of these units, in particular the width of the stretching tool 12, must be adapted accordingly to match the dimension of the container R, and the travel of the stretching tools must be controlled as a function of the "transverse" dimension of the container R, the height of the sleeve M and its position on the container R. The adjustments will be made primarily by adjusting the spacing of the flanges constituting the turret 9, the control cams and/or jacks integrated in the placing units.

The turret 9 and the drum 7 are synchronised and the number of pieces of equipment carried by each of them is such that a transfer element 8 of the transfer drum 7 will always encounter a placing unit 10 of the placing turret 9 in the transfer zone. This situation is illustrated in FIG. 2, which illustrates the instant at which a placing unit 10 meets sleeve M, held open by the arms 81, 82 of a transfer element 8.

At this instant, the placing unit is in a grouped configuration, enabling it to penetrate the sleeve M, which is merely held open, but is not stretched, by the two arms 81, 82 of the transfer element 8. The vacuum at the suction surfaces 84, 85 of the arms 81, 82 is then switched off, thereby releasing the sleeve M, which stays on the placing unit 10. By means of the stretching tools 12 and the blocks 13, this placing unit holds the sleeve M so as to detach it if it still happens to be stuck due to charges of static electricity. The stretching tools 12 are then moved apart in the transverse direction, perpendicular to FIG. 2, so that the sleeve M gradually assumes an opening bigger than the contour of the container R on which the sleeve is to be fitted. This opening action is effected as the placing turret 9 rotates and the sleeve M is thus transported as far as the placing zone 14.

A container feed 15, provided in the form of an endless conveyor belt 16 co-operating with two feed screws 17, synchronises the movement and positioning of the containers R so that each container arrives in the placing zone 14 at the same time as the placing unit 10 carrying its sleeve M. The feed 15 delivers the containers R so that their base Fo is turned towards the placing unit 10 and its sleeve M.

As it approaches the placing zone 14, the placing unit 10 oscillates so that it departs from its position perpendicular to the radial direction of the turret 9, leaning at an angle as it moves into a position parallel with the base Fo of the container (or more generally a position "parallel with the container").

FIG. 3 provides a schematic illustration of how the sleeve M and the placing unit 10 engage on a container in the placing zone 14, the placing elements being illustrated in a simplified format without the clamping blocks 13, which would be to the fore and rear of the plane of FIG. 3.

The placing unit 10 slides the sleeve M over the base Fo of the container R until the sleeve reaches the intended position. From this instant, the stretching tools are retracted from the gap between the wall of the container and the sleeve, whereas the clamping blocks continue to be applied against the sleeve without being moved relative to the container. Once the stretching tools have been withdrawn from the gap, the clamping blocks are also moved apart and release the container fitted with the sleeve.

The relative movement of the stretching tools 12 with respect to the container R starts with the placing unit 10 and sleeve moving towards the container, passing firstly from above the base Fo and then moving forward in the direction towards the rim B, or, more generally, the opening of the container. Having fitted the sleeve M under the conditions outlined above, the stretching tools 12 are retracted by a movement in the opposite direction of the movement effected in order to place the sleeve M, after which, once the stretching tools 12 have been retracted, the clamping blocks 13 can be retracted and moved back onto the stretching tools 12 by a relative movement. However, the simple removal of the stretching tool from the gap between the container and the sleeve enables the sleeve to be applied against the container and the clamping block released. The latter will then be released from the container by the rotating motion of the placing turret, beyond the region in which the cam 20 operates.

In the machine illustrated as an example in FIG. 2, this relative movement, involving the moving together and releasing action, in the directions indicated takes place in a substantially vertical direction, the containers being placed on the conveyer 16 in the upturned position, with the base Fo directed upwards, so that the placing units 10 are displaced from above each container R in the placing zone 14. The placing units 10 supported by the turret 9 move downwards in conjunction with the rotating motion of the turret 9, which has a horizontal axis. The same applies to the axis of the transfer drum 7 positioned above the placing turret 9. The feed system with the reel 2 of sheath and, at the output, the cutting device 5, are mounted above the transfer drum 7. The advantage of this height configuration is that there is less cumbersome machinery at ground level, as well as the fact that it uses the weight to facilitate some of the transfer movements, for example feeding the sheath 3 through the drive rollers 6 upstream of the cutting device 5 and then through the cutting device and lowering the cut sleeve M into the transfer elements 8 of the drum 7.

As a general rule, the machine described above operates on the basis of a continuous kinematic principle, all the operations being effected without the machine stopping, in particular from picking up the sleeves M at the output of the cutting device 5 up to the point at which they are placed on the containers R and the container feed 15.

FIGS. 4 to 7C provide a more detailed illustration of the various elements of the apparatus illustrated in FIG. 1.

FIG. 4 depicts a transfer element 8 with the two arms 81, 82 in the open position, in the area where the sleeve M is received. The arrival of the sleeve is indicated by a vertical arrow C. The two arms 81, 82 have boxes 86, 87 on their ends incorporating the suction surfaces 84, 85. The arms 81, 82 themselves comprise twin tubes, at least one of which is linked to a vacuum source, which is switched on in order to create a vacuum in the box behind the gripping surface and across it, holding the sleeve by vacuum pressure.

These arms 81, 82 are of a modular design, which enables their length to be adapted to the transfer drum 7 conforming to the other specifications of the apparatus. The vacuum boxes 86, 87 with the suction surfaces are also mounted on the end of the arms 81, 82 so as to be detachable, which means that they can be easily replaced if a part becomes damaged. The transfer elements are symmetrical relative to the plane of symmetry formed by the sleeve, for example. The elements are interchangeable but as there is one element upstream and one element downstream, they have been distinguished from one another by different reference numbers. The same does not apply to the placing elements, which are not only identical but also operate in exactly the same way and are therefore simply distinguished from one another by the suffix A or B.

FIG. 5 illustrates the transfer zone between the transfer drum 7 and the placing turret 9. The transfer element 8 has been rotated by 180°. Having been illustrated in a position open at the top in FIG. 4, it is shown in a position open at the bottom in the transfer zone in FIG. 5. To keep the drawing simple, the sleeve is not illustrated. The transfer element 7 is in the open, released position and the placing unit 10 has two placing elements 11 (placing element 11A on the left-hand side and placing element 11B on the right-hand side) in the position ready to receive the sleeve. These two elements essentially move into the gap of the opening between the two arms 81, 82 of the placing element 8 so that they enter the opening of the sleeve in the deployed but not yet stretching state, the sleeve still being adhered to the suction surfaces 81, 82 of the two arms of the transfer element 8.

At this point, the vacuum pressure in the box 86, 87 is switched off in order to release the sleeve. It moves firstly between the stretching tools 12A, 12B and the clamping blocks 13A, 13B, retracted relative to the stretching tools 12A, 12B, after which the blocks move against the stretching tools in order to hold the sleeve, at least during the transfer process.

The structure of the placing unit 10 will be described in more detail with reference to the subsequent drawings. However, it should be pointed out that, as illustrated in FIG. 5, the transfer element 8 has two arms located on each side, one to the front of and the other to the rear of FIG. 5.

In FIG. 5, the placing unit 10 is illustrated in the position in which it receives the sleeve, in which the stretching tools 12A, 12B and the clamping blocks 13A, 13B are turned upwards, whereas in the placing zone 14, this unit will be rotated by 180°. As also illustrated in this drawing, the placing elements of the placing units are of an identical shape and interchangeable, and only one of them will therefore be described.

FIGS. 6A–6C show three views of a placing element 11.

This placing element 11 has a support 11-1 bearing the stretching tool 12 and a clamping block 13. The stretching tool 12 is linked to a body 11-2, enabling a relative movement in translation between the stretching tool 12 and the support 11-1 in the direction of double arrow D, which is the stretching or transverse direction.

The support 11-1 bears the clamping block 13, which is mounted so that it slides in the direction of double arrow F on two guide posts 11-3.

The active part of the stretching tool 12 which has a curved contour is made up of two thin parts 12-1, 12-2, with a shell-type shape designed to straddle the corresponding two corners of the container R as the sleeve M is being fitted. The front surface 12-3 (as it is in FIG. 6A) is disposed at the side of the container, whilst the rear surface 12-4 is the one which carries the sleeve. It is smooth and continuous; it is preferably defined by part of a cylindrical surface, i.e. a surface generated by a straight line supported on a generatrix formed by two straight segments joined by a curve, this generatrix being substantially equal to the section of a corner of the container. At the top part, as it is in the orientation illustrated in 6A–6C, the stretching tool 12 has a turned-back piece 12-5 by which it is mounted on the body 11-2.

The clamping blocks 13 are of a shape complementing that of the shells 12-1, 12-2 of the stretching tool 12 so that they are applied against them and clamp the sleeve. The surface of the block matches the shape of the stretching tool but this surface is provided in the form of a fitting 13-1 on a level with each corner and has a certain capacity to adhere to the sleeve and preferably also a certain degree of elasticity so as to clamp the sleeve against the stretching tool without crushing or damaging it, given that in one phase, the block 13 must hold the sleeve against the stretching tool 12 and, in another phase, must hold the sleeve M whilst the stretching tool 12 is being retracted.

FIG. 6A illustrates the stretching tool 12 and the clamping block 13 spaced at a distance (E) apart to enable the sleeve to be positioned.

In effect, when the placing element 11 (or the placing unit of which it is a part) receives the sleeve, it is placed in a position rotated by 180° relative to the position illustrated in FIG. 6A.

FIG. 6B is a view similar to that illustrated in 6A, but the clamping block 13 is applied against the stretching tool 12 in order to close the gap and grip the sleeve, not illustrated.

These different movements are controlled by cams and jacks integrated in the placing element or the placing turret.

FIG. 6C shows a side view of the placing element, specifically showing a wheel 13-4 supported by the clamping block 13 and controlling the relative movement of it with respect to the stretching tool in the placing zone; this movement is effected in the direction of double arrow F, guided by the two posts 11-3 supporting the block 13.

FIGS. 7A–7B illustrate the relative movement of a placing unit 10 and a container R in the placing zone 14.

FIG. 7A illustrates two relative positions, the movement being effected from the left towards the right. In the left-hand part, the placement unit 10 is lowered with the sleeve so that it is moved onto the container R. The sleeve is set in place but at this moment, the stretching tools 12 are still in the gap between the wall of the container and the sleeve. This drawing clearly illustrates how the sleeve is applied directly to the wall of the container and is so over a large part of the side walls.

From this instant, corresponding to the point at which the sleeve is placed precisely in the intended position, a control system, in particular a cam which is not illustrated, lifts the stretching tools 12 in order to leave the gap free. The stretching tools thus move into the position illustrated on the right-hand side. In this position, the clamping blocks 13 are still in the bottom position applied against the sleeve M. The clamping blocks 13 are held in this bottom position by their wheels 13-4 passing underneath a cam 20.

After the position illustrated on the right-hand side of FIG. 7A, the clamping blocks 13 are shifted to the side in order to move them apart from the sleeve and then raised to rejoin the stretching tools. This third position is not illustrated.

FIG. 7B illustrates a side view corresponding to FIG. 7A. This drawing specifically shows the cam 20 and the wheel 13-4 of the clamping block 13, held in the bottom position by the cam, whereas other guide means, such as a cam, have raised the stretching tools 12.

FIG. 8 gives a different perspective view of a placing element co-operating with a container. This drawing shows a placing element 11 at the instant at which it reaches the position in which it places the sleeve on the container (the second placing element is not illustrated).

The invention claimed is:

1. Apparatus for placing stretchable sleeves on containers in the form of substantially prismatic cartons which can be stacked, the opening of which is at least partially surrounded by a rim projecting out towards the exterior, characterised in that it comprises a sheath feed which unreels a stretchable sheath into a sleeve cutting device, a transfer drum equipped with transfer elements picking up each sleeve at the output of the cutting device in order to open it and transfer it to a placing unit, a placing turret equipped with placing units having at least two placing elements, each with a stretching tool and a clamping block to pick up a sleeve from a transfer element, stretch the sleeve and clamp it against the stretching tool with the clamping block, a container feed, the container feed being able to place the container in a placing zone, in steps in synchronisation with the placing elements, the base of the container being turned towards the placing elements in the placing zone, a set of control means managing the relative motion of the placing elements with respect to the container in the placing zone, the placing elements being controllable to place the sleeve on the container by moving it from above the base of the container in the direction towards the rim until the sleeve sits on the container in the intended position, and to release the sleeve by retracting the stretching tools relative to the sleeve from a gap between a wall of the container and the sleeve, the clamping block remaining in position set back from the stretching tools.

2. Apparatus for fitting stretchable sleeves as claimed in claim 1, characterised in that the transfer elements each have two arms which are controlled so as to pivot relative to one another so that they can be moved towards or apart from one another, and the two arms are terminated by vacuum boxes provided with mutually facing vacuum suction surfaces, the arms substantially radial to the transfer drum, the vacuum in the arms being controlled depending on the rotary position of the transfer drum.

3. Apparatus for fitting stretchable sleeves as claimed in claim 1, characterised in that each placing element comprises a support bearing the stretching tool and the clamping block, the support being fitted with guide and control means in order to guide the stretching tool in translation in the stretching direction and the block in a direction substantially parallel with the rear surface of the stretching tool.

4. Apparatus for fitting stretchable sleeves as claimed in claim 3, characterised in that the support of the placing element has two posts on which the clamping block is mounted so as to slide.

5. Apparatus for fitting stretchable sleeves as claimed in claim 3, characterised in that the stretching tool is provided in the form of a curved block comprising two parts of a thin shell-type shape, designed to straddle the corresponding corner edges of the container as the sleeve is being set in place.

6. Apparatus for fitting stretchable sleeves as claimed in claim 5, characterised in that the clamping block has a surface complementing the rear surface of the stretching tool and has fittings on a level with each corner, which co-operate with the rear surface of the shell-type shaped parts of the stretching tool, these fittings having a higher capacity to adhere to the sleeve material than that of the rear surface of the shell-type shaped parts of the stretching tool.

7. Apparatus for fitting stretchable sleeves as claimed in claim 1, in the fitting zone, the placing element having a support bearing the stretching tool, and said apparatus comprising control means in the form of a cam, and the clamping block of each placing element has a wheel co-operating with the cam in order to hold the clamping block immobile relative to the container in the placing zone, and control means co-operating with the support in order to control the motion of the stretching tool freeing the gap between the sleeve and the container.

8. Apparatus for fitting stretchable sleeves as claimed in claim 1, in the fitting zone, said apparatus comprising control means in the form of a cam, and the clamping block of each placing element has a wheel co-operating with the cam in order to hold the clamping block immobile relative to the container in the placing zone, and control means co-operating with the stretching tool in order to control the motion of the stretching tool freeing the gap between the sleeve and the container.

* * * * *